United States Patent [19]

Herrig et al.

[11] 4,249,359

[45] Feb. 10, 1981

[54] APPARATUS FOR THE COILING OF WIRE-MESH WEBS, ESPECIALLY CHAIN-LINK FENCING, INTO COMPACT ROLLS

[75] Inventors: Klaus Herrig; Heinz Wagner, both of St. Ingbert, Fed. Rep. of Germany

[73] Assignee: Acieries Reunies de Burbach-Eich-Dudelage S.A. Arbed, Luxembourg

[21] Appl. No.: 967,849

[22] Filed: Dec. 8, 1978

Related U.S. Application Data

[62] Division of Ser. No. 848,324, Nov. 3, 1977, Pat. No. 4,139,976.

[30] Foreign Application Priority Data

Nov. 4, 1976 [DE] Fed. Rep. of Germany ..... 2650590

[51] Int. Cl.[3] ..... B65B 63/04

[52] U.S. Cl. ..... 53/118; 242/54 R

[58] Field of Search ..... 53/118, 430; 242/54

[56] References Cited

FOREIGN PATENT DOCUMENTS

| | | | |
|---|---|---|---|
| 830548 | 10/1975 | Belgium . | |
| 1161450 | 8/1958 | France | 53/118 |
| 1594975 | 7/1970 | France . | |
| 2312315 | 12/1976 | France | 53/118 |
| 834449 | 5/1960 | United Kingdom . | |

*Primary Examiner*—Travis S. McGehee
*Attorney, Agent, or Firm*—Karl F. Ross

[57] ABSTRACT

Wire-mesh webs formed from interengaged flattened spirals, especially chain-link fencing, upon manufacture are coiled by twisting the planes of the spirals so that they fit tightly together and almost coincide with axial planes of the roll. During the coiling process, one to three tension elements are introduced into the corresponding troughs of the successive undulations formed by the successive spirals and are maintained under tension during coiling to maintain the spirals in their substantially erect condition. The result is a highly compact roll.

3 Claims, 1 Drawing Figure

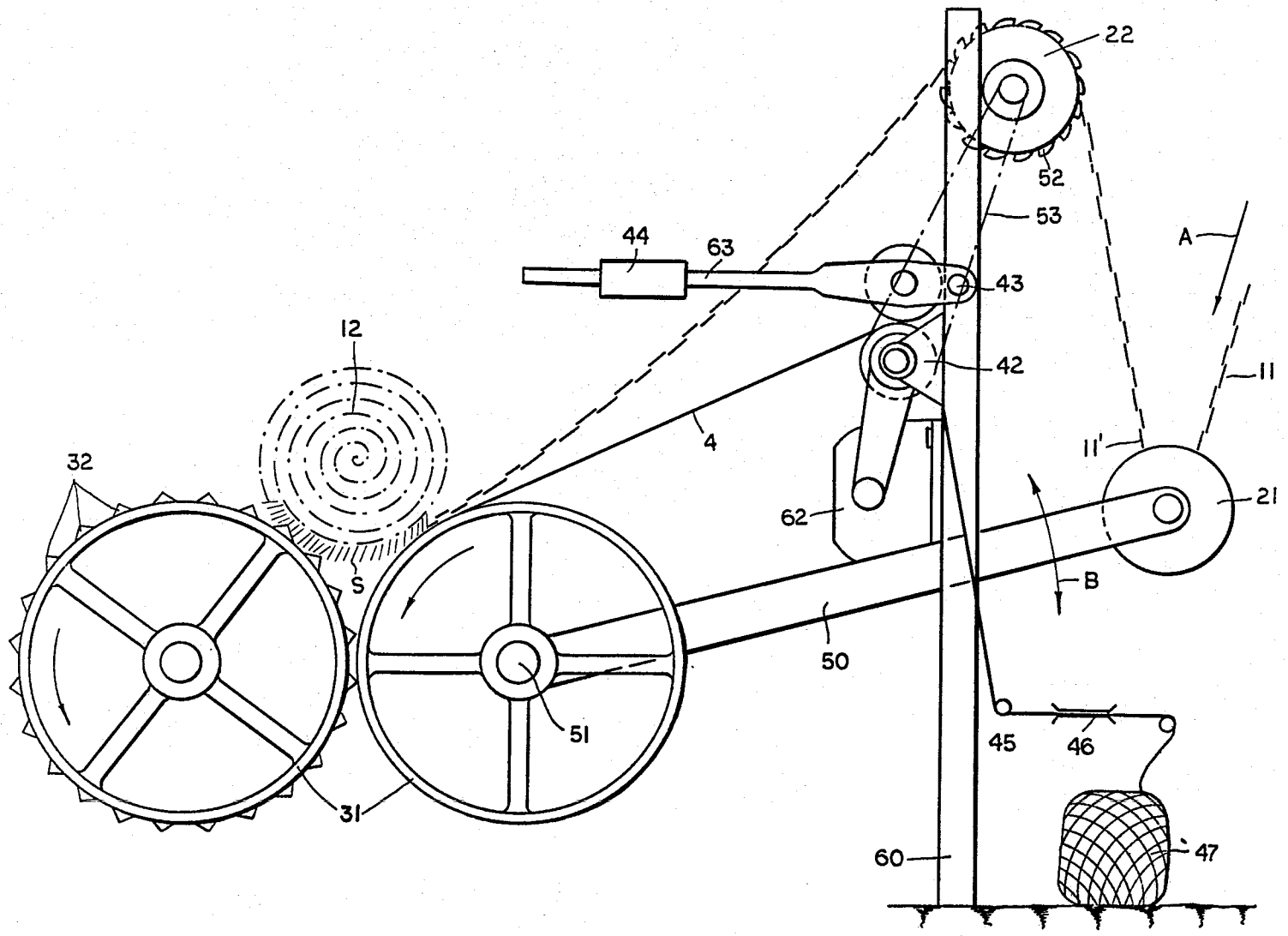
A
11
11'
21
22
52
53
43
42
B
46
47
45
60
50
62
4
63
44
51
12
S
31
32

APPARATUS FOR THE COILING OF WIRE-MESH WEBS, ESPECIALLY CHAIN-LINK FENCING, INTO COMPACT ROLLS

CROSS REFERENCE TO RELATED APPLICATIONS

This application is a division of copending application Ser. No. 848,324 filed Nov. 3, 1977 now U.S. Pat. No. 4,139,976, issued Feb. 20, 1979 and is related to application Ser. No. 848,322, now U.S. Pat. No. 4,124,183.

FIELD OF THE INVENTION

The present invention relates to an apparatus for the coiling of wire mesh, especially so-called chain-link wire mesh, into rolls. More particularly, the invention relates to the formation of rolls of such mesh directly upon manufacture thereof and as a continuation of the feed of the web of mesh from the fabricating machine.

BACKGROUND OF THE INVENTION

In the production of wire-mesh web, for use as enclosures or the like, the reticulate or lattice-like web has mesh openings of square or rhomboidal configuration and can be composed of spirals having a pitch of about 45° which are flattened and formed continuously from a wire in a machine for producing such mesh.

Using the mesh blade and worm, this wire is coiled into the spiral and feed transversely of the web while being rotated to interengage with a previously formed flattened spiral. The spiral length is cut at one edge of the web, once the spiral has reached the other edge, and adjacent spirals are twisted together at their free ends along these edges of the web or have their free ends hooked together or bent over one another to secure the spirals in place.

This sequence of operations generates a web of the chain-link fencing type in which the wire spirals have a zig-zag configuration with interengaged crests and troughs.

The operation is carried out at relatively high speed and the web of chain-link mesh passes out of the machine substantially continuously.

It is a common practice to roll up or coil these webs on coiling installations downstream of the mesh-making apparatus into rolls which are more easily handled, transported and stored than the flat or planar web produced in the machine.

In German printed application (Auslegeschrift) No. DAS 1 041 902, there is described a coiling device which comprises as its most significant part, a pair of driven rotary bodies in parallel relationship which are disposed transversely to the direction of advance of the web, i.e. athwart the web. The roll is formed upon these bodies and the peripheries of the bodies are provided with entraining formations to engage in the mesh of the web so as to bring about the coiling operation.

The peripheral speed of the rotary bodies is greater than the feed speed of the web so that the web is stretched tightly upon coiling.

The rolls produced by this process and apparatus are not especially compact and hence have the disadvantage that they occupy, for a given length of the web, relatively large volumes, thereby taking up considerable storage and transport space. When the mesh is coiled in a stretched condition, the successive spirals do not materially interfit.

It has been proposed to improve the packing density of such wire mesh and chain-link fencing by mechanically pressing the successive spirals together. In other words, instead of the band being stretched for coiling, it is condensed in length and assembled into balls with rectangular cross-section by folding (German Pat. No. 1,178,350) or into cylindrical rolls (German Pat. No. 1,552,156).

In the latter publication, the apparatus for coiling the mesh of chain-link fencing into compact rolls comprises a supply roller and a support for the mesh which is constituted by a movable endless flexible belt having an upper pass or stretch suspended between a pair of guide rollers.

As the web supplied from a substantially vertical plane over the feed roller engages the endless belt, the mesh rows are shoved together as a result of the reduced downstream speed of the belt and, because of the catenary shape of the suspended upper stretch, is coiled into the rolls.

Such rolls have indeed a greater packing density than the rolls of stretched chain-link fencing, although they still are not at a maximum compactness. The flattened wire spirals have their planes substantially tangential to the surface of the roll.

In addition, these rolls have the disadvantage that at least the outer turn of the web must be in a stretched state and fastened with wire to impart the requisite stability to the roll. Otherwise the turns tend to shift upon handling.

A further disadvantage of this coiling process is that special coiling apparatus is required which may not be available at the plants usually used to produce chain-link fence. As a consequence, capital expenditure is required for new equipment if the advantages of the more compact rolls are to be obtained.

OBJECT OF THE INVENTION

It is the principal object of the present invention to provide an improved system for the forming of compact packages of wire mesh and especially chain-link mesh upright the aforedescribed disadvantages can be obviated.

Another object of the invention is to provide an improved apparatus for the production of compact rolls of chain-link mesh.

SUMMARY OF THE INVENTION

These objects and others which will become apparent hereinafter are attained, in accordance with the present invention, in an apparatus for producing compact rolls of wire mesh formed from interengaged flattened spirals, especially the compact rolls described in the aforementioned U.S. Pat. No. 4,124,183. According to this invention, a pair of parallel drums (rotary bodies) are disposed transversely to the path of the web and the latter is coiled on these drums without a mandrel or core into the rolls. According to the invention, the web is fed onto the upstream drum from above while the downstream drum is provided with formations engaging in the roll.

The drums are rotated in the same sense and, in accordance with an important feature of the invention, the downstream drum brakes the rotation of the roll while the upstream drum advances the web at a higher speed so that the flattened spirals are twisted sharply out of the plane of the web and, advantageously, into an orientation in which the plane of each spiral includes an angle of about 15° with a corresponding axial plane of the roll.

Thus, the spirals are advanced by the upstream and driven drum with substantially the same peripheral speed as the speed of advance of the web or slightly greater, while the roll is retarded by the downstream drum so that in the gap between the drums, the aforedescribed twist and fitting together of the flattened spirals takes place.

It has been found to be advantageous to provide at least one and preferably up to three binding strands within the roll as the latter is coiled to control the assembly of the coils into their substantially upright orientations and to retain these orientations from turn to turn along the roll. The binder strand or strands can be connected to the starting spirals of the roll and can lie in common troughs of the zigzag or undulating strips formed by the twisted rolls, thereby preventing reverse twisting of the spirals. When the roll is completed, these strands can hang loosely from the roll to facilitate uncoiling (see the aforementioned application).

The binder strands, which can be tensioned as they are laid into the roll, can be composed of wire, rope, cable bands or cords of metal, natural fibers or synthetic resins.

For commerical size chain-link fence width of 0.5 to 2 meters, 1 to 3 such binder strands are provided. These dimensions, of course, correspond to the height of the roll.

The roll is coiled, according to the invention, with the binder strands wound into it, with a ratio of the peripheral speed of the coil to the speed of advance of the chain-link web of 1:5 to 1:4, the roll being correspondingly braked. Since a tension is maintained upon the binder thread or threads, the roll is braked and the speed of the upstream drum can be equal to the peripheral speed of the web, the successive flattened spirals are not only forced tightly against the preceding spirals but are also twisted so that their planes are rotated sharply relative to the web plane (e.g. about 75°) to bring about the optimum packing density.

It has already been mentioned that the plane of the flattened spiral can include an angle to an axial plane of the roll of about 15° with the compact roll of the present invention and as contrasted with a corresponding angle of about 90° with a roll formed from a stretched web.

While a roll formed from a stretched web has the full square-mesh pattern visible on its surface, the compact roll of the present invention has a typical zigzag appearance corresponding to the undulating configuration of the spirals seen on edge.

The binder strands lie along at least two troughs proximal to the ends of the roll and, in addition, the compact configuration of the latter can be maintained by providing a plurality of ties which also can lie in troughs of the periphery of the roll.

When rolls of this type are stacked, the crests and troughs respectively engage the troughs and crests of adjoining rolls so that the volume occupied by the compact roll of the present invention is 70% less than that of a roll of the same length of chain-link fencing in a stretched condition and 40% less than a roll of chain-link fencing with spirals shifted together.

The binding strands which are fed to the roll during the feeding, twisting and packing of the spirals, have been found to have additional advantages. For example, the strand even in a loose state assists in maintaining the compact orientation of the spirals and serves to guide the successive spirals into the proper packed orientation. It is thus unnecessary to provide guided rollers along the lateral edges of the web for preventing transverse shifting of the spirals. The centering and proper location of the successive spirals in the roll is thus automatic. In addition, the binder strands can be used, if desired for tying the roll together. In this case it is merely necessary to increase the length of the binder strands and press them fully around the rolls to secure them at the points at which they emerge from the mesh.

The binder strands, in addition, facilitate an uncoiling of the rolls and have been found to have a highly advantageous effect in preventing binding of the hooked or twisted ends of the spirals.

The apparatus of the present invention comprises the two rotatable bodies or drums, mentioned previously, whose axes are disposed parallel to one another and transverse to the direction of advance of the chain-link mesh web, these drums serving to form the roll. Between the mesh-fabricating machine and these drums, the apparatus can be provided with a feed roller and a guide roller.

The apparatus is also provided with means for supplying at least one binder strand to the web as it is coiled in the roll and for maintaining the tension of this strand as the roll is formed. This latter means can include a supply of the strand, e.g. a spool or coil of wire or cord, and a pair of feed rolls between which the strand passes and which are carried by a support frame for the apparatus. At least one of the feed rolls can be driven while the other is biased against the first, e.g. by a weight, spring or the like. A tension device or strand brake of any conventional construction can limit the rate at which the strand is fed to the roll.

Naturally, the machine frame or support can be provided with as many guide or feed devices as there are binder strands to be incorporated in the roll. However, it is also possible to feed a plurality of such strands simultaneously through a single pair of feed rolls. In this case, additional deflecting rollers may be used to ensure proper positioning of the strands.

BRIEF DESCRIPTION OF THE DRAWING

The above and other objects, features and advantages of the present invention will become more readily apparent from the following description, reference being made to the sole FIGURE of the accompanying drawing which is a diagrammatic side-elevational view of an apparatus embodying the invention.

SPECIFIC DESCRIPTION

Chain-link fencing 11, in the form of a web fabricated by an automatic machine for this purpose (see the aforementioned copending application) is fed downwardly as represented by the arrow A in a stretched condition around a compensating drum 21 which is mounted upon a pair of arms, one of which can be seen at 50 in the drawing. The arms 50 are swingable about the horizontal axis 51 and tend to move downwardly under their own weight so that they draw the loop 11' of the web downwardly but can yield when the web 11 is advanced at an accelerated rate. Hence the drum 21 describes an arcuate movement as represented by the arrow B.

The rising web 11 passes from the drum 21 over a driven feed drum 22 which is provided on its periphery with projections 52 engaging into the openings of the mesh to positively advance the latter. The drum 22 is driven by the belt 53 of an electric motor 62.

Any conventional control means responsive to the rate of fabrication of the web or the tightness of the coil produced, may control the motor 62.

The roll 12 of the chain-like mesh is formed on a pair of spaced-apart rotary bodies or drums 31 which are driven by means (not shown) in any conventional manner. The drums each may consist of a multiplicity of disks keyed to a common shaft.

All of the disks or at least a portion of them, of the downstream drum, are provided with projections 32 along their periphery, these projections being constituted as pyramidal projections.

The upstream drum is driven with a peripheral speed slightly greater than that of the feed roller 22 while the downstream drum is operated at a substantially lower peripheral speed.

The downwardly hanging web thus meets the upstream drum 31 at the point at which it osculates the roll 12 and, because of the relative speeds of the roll and the upstream drum, twists the oncoming flattened spiral into the orientation shown diagrammatically at S in which it is practically radial or at most includes an angle of 15° with an axial plane of the roll.

On the roll 12 there are tied a pair of synthetic resin (e.g. nylon) cords 4 at distances of 15 to 45 cm from the axial ends of the roll, these cords being passed below the web and hence between the web and the periphery of the upstream drum. The cords 4 are maintained under tension and are fed at a speed which may be, for example, half the velocity of the web. The cords prevent the roll 12 from rotating excessively on the bodies 31, guide the successive twisted spirals into place, and have the other advantages previously described. The spirals are packed together in their twisted orientations and this orientation is in part maintained by the cords.

It will be apparent that the optimum ratio of web to cord feed rates corresponds, for a given mesh quality, to the maximum degree to which the successive spirals can be pused together.

The cord-feed device comprises a pair of rollers 42 and 43 mounted upon the machine frame 60. The lower roller 42 is driven by the motor 62 and is connected by the belt 53 to the drum 22, the belt 53 establishing the necessary synchronization of the web advance with the cord feed. The cord 4 passes from a spool 47 via deflecting rollers 45 through a tensioning device 46 over the roller 42 against which it is pressed by the roller 43. The latter is mounted on an arm 63 carrying a weight 44 which can be adjusted along the length of the arm 63 to vary the pressure upon the cord 4. The cord or cords 4 can be guided parallel to or at an inclination to the web. In the latter case, no engagement prior to incorporation of the cord in the web occurs. When a given length of the mesh is accumulated on the roll 12, the latter is cut free from the web and the cords are severed. The roll can be removed and strapped or otherwise tied and the cord 4 attached to the spiral at the end of the mesh preparatory to the formation of a new roll. As described in the aforementioned patent, the roll has a zigzag outer configuration and is somewhat concave or drawn in at the center. The maximum diameter of a length of 25 meters formed from wire having a diameter of 2.8 mm coated with plastic and a mesh opening 50 mm on a side is 30 cm measured at the crests. The diameter at the troughs is about 6 cm smaller. When these rolls are stacked, the effective diameter is 27 cm because of the interengagement of the crests and troughs of the rolls, corresponding to a center-to-center spacing of 27 cm.

We claim:

1. An apparatus for the coiling of a roll of a chain-link wire-mesh web comprising:

a pair of rotary bodies including an upstream body and a downstream body rotatable at a relatively high speed and a relatively low speed respectively;

means for feeding said web into contact with said upstream body whereby said web is coiled into a roll cradled between said bodies with successive flattened spiral coils forming the web packed tightly together and twisted out of the plane of the web;

means for introducing into said roll a tension strand connected to a first of said spiral coils and coiled in said roll with said coils to guide the successive flattened spirals to maintain the orientation thereof; and means for synchronizing said feeding means and said introducing means to maintain a predetermined tension on said strand as the different speeds of said bodies ensures twisting of the successive flattened spirals out of the plane of the web pack said spirals together, the last-mentioned means including a pair of rollers feeding said strand between them, one of said rollers being driven, the other of said rollers being urged by a force toward said one of said rollers.

2. The apparatus defined in claim 1 wherein a plurality of such strands pass between said rollers to enter said roll.

3. The apparatus defined in claim 1 wherein said downstream body is provided with pyramidal-shape projections engaging said roll.

* * * * *